US005967799A

United States Patent [19]

Arai

[11] Patent Number: 5,967,799

[45] Date of Patent: Oct. 19, 1999

[54] STRUCTURE OF PRINTED CIRCUIT BOARDS COUPLED THROUGH STACKING CONNECTORS

[75] Inventor: Nobuhiro Arai, Tokyo, Japan

[73] Assignee: NEC Corporation, Tokyo, Japan

[21] Appl. No.: 08/928,511

[22] Filed: Sep. 12, 1997

[30] Foreign Application Priority Data

Sep. 18, 1996 [JP] Japan ..... 8-246131

[51] Int. Cl.[6] ..... H01R 9/09

[52] U.S. Cl. ..... 439/67; 439/108

[58] Field of Search ..... 439/67, 74, 92, 439/108

[56] References Cited

U.S. PATENT DOCUMENTS

| | | | |
|---|---|---|---|
| 5,186,632 | 2/1993 | Horton et al. | 439/74 |
| 5,199,884 | 4/1993 | Kaufman et al. | 439/74 |
| 5,556,286 | 9/1996 | Ikesugi et al. | 439/74 |

FOREIGN PATENT DOCUMENTS

| | | |
|---|---|---|
| 2-22944 | 6/1990 | Japan . |
| 5-87868 | 11/1993 | Japan . |
| 7-183058 | 7/1995 | Japan . |
| 7-29585 | 7/1995 | Japan . |

OTHER PUBLICATIONS

Japenese Office Action, dated Jan. 19, 1999, with English language translation of Japenese Examiner's comments.

*Primary Examiner*—Paula Bradley
*Assistant Examiner*—Katrina Davis
*Attorney, Agent, or Firm*—Whitham, Curtis & Whitham

[57] ABSTRACT

Signal lines and ground lines formed on a major surface of a printed circuit board are electrically connected to signal lines and ground lines on a major surface of a flexible printed circuit film opposed to the major surface of the printed circuit board through a stacking connector, a conductive coupling member and another conductive coupling member are attached to a first ground pattern formed on the major surface of the printed circuit board and a second ground pattern formed on the reverse surface of the flexible printed circuit film, and the conductive coupling members are engaged with each other so as to provide a bypass of the conductive paths in the stacking connector for the ground lines and a shield against electro-magnetic noise radiated from the stacking connector.

15 Claims, 2 Drawing Sheets

STRUCTURE OF PRINTED CIRCUIT BOARDS COUPLED THROUGH STACKING CONNECTORS

FIELD OF THE INVENTION

This invention relates to a structure of printed circuit boards and, more particularly, to a structure of printed circuit boards coupled through stacking connectors.

DESCRIPTION OF THE RELATED ART

One of the basic requirements for a notebook type personal computer is a small thin light case equipped with a wide display. The small thin light case is expected to pack circuit components mounted on a printed circuit board structure, and the dimensions of the case is strongly affected by the size of printed circuit board structure. If the circuit components mounted on a unit area is increased, the printed circuit board structure is shrunk, and, accordingly, the case becomes small.

One of the approaches for increasing the density is to couple a printed circuit board to another printed circuit board by means of a stacking connector. A typical example of the printed circuit board structure is disclosed in Japanese Utility Model Publication of Unexamined Application No. 5-87868. The Japanese utility Model Publication of Unexamined Application proposes to connect a flexible printed circuit film to a main printed circuit board by means of a stacking connector. The flexible printed circuit film multiplies the area for mounting the circuit components, and the stacking connector connects signal lines and ground lines on different levels. Signal lines and a ground pattern on the main printed circuit board are connected through conductive paths formed in the stacking connector to signal lines and a ground pattern on the flexible printed circuit film.

Another prior art printed circuit board structure is disclosed in Japanese Patent Publication of Unexamined Application No. 7-183058. The Japanese Patent Publication of Unexamined Application also proposes to connect a sub-printed circuit board to a main printed circuit board by means of a stacking connector. The Japanese Patent Publication of Unexamined Application further proposes to use anti-separation plates. The anti-separation plates have respective belly portions, and are assembled with the main board in such a manner that the belly portions are opposed to each other. When the connector on the sub-printed circuit board is coupled to the connector on the main circuit board, the belly portions press the sub-printed circuit board toward the main circuit board, and prevents the connector on the sub-printed circuit board from separation from the connector on the main printed circuit board. The anti-separation plates are formed of conductive metal, and are soldered to a ground pattern on the reverse surface of the main circuit board. An earth pattern is also formed on the reverse surface of the sub-printed circuit board. When the sub-printed circuit board is coupled to the main printed circuit board, the belly portions are held in contact With the earth pattern, and the earth pattern is electrically connected through the anti-separation plates to the ground pattern on the main circuit board. Thus, the signal lines and the ground pattern are electrically connected to the signal lines and the earth pattern through not only the stacking connector but also the anti-separation plates.

In general, it is undesirable for the printed circuit board structure to decrease the signal lines and the ground lines in the stacking connector. The first prior art printed circuit board structure propagates all the signals and the ground potential through the stacking connector. When the signal lines on the printed circuit boards are increased, it is necessary to share some ground lines between the signal lines in the stacking connector, or the stacking connector is replaced with a large stacking connector. If the ground line is shared between the signal lines, potential difference tends to take place between the ground lines due to the current flowing from the associated signal lines, and the potential difference is causative of electro-magnetic noise. The electro-magnetic noise affects the signals propagating on the signal lines, and a malfunction takes place.

On the other hand, if the stacking connector is enlarged, the large stacking connector occupies wide area, and the prior art printed circuit board structure undesirably becomes large. For this reason, when the manufacturer employs the first prior art printed circuit board structure, the ground lines are shared between the signal lines, and the stacking connector of the first prior art printed circuit board structure becomes an electro-magnetic noise source.

In the second prior art printed circuit board structure, the anti-separation plates serves as a bypass for the ground potential, and the ground potential is propagated through the anti-separation plates and the conductive paths of the stacking connector assigned to the ground potential. The anti-separation plates decrease the impedance between the ground pattern on the main printed circuit board and the earth pattern on the sub-printed circuit board; however, the ground/earth lines spaced from the anti-separation plates are slightly higher in potential level than the ground/earth lines close to the anti-separation plates.

SUMMARY OF THE INVENTION

It is therefore an important object of the present invention to provide a printed circuit board structure which decreases electro-magnetic noise without enlargement of a stacking connector.

In accordance with one aspect of the present invention, there is provided a printed circuit board structure comprising a first printed circuit member having signal lines, around lines and a ground plate formed on a major surfaces thereof, a second printed circuit member having signal lines and ground lines formed on one of major surfaces thereof and a second ground plate formed on the other of the major surfaces, a stacking connector having a first length inserted between the first printed circuit member and the second printed circuit member in such a manner as to be overlapped with the second ground plate, and having a plurality of conductive paths connected between the signal lines and the ground lines of the first printed circuit member and the signal line and the ground lines of the second printed circuit member, and a coupling unit having a second length not shorter than the first length, and including a first conductive block attached to the first ground plate and having a first engaging portion, and a second conductive block attached to the second ground plate and having a second engaging portion engaged with the first engaging portion, thereby locating the stacking connector a space between the first printed circiut member and the second circuit member at the back of the coupling unit.

BRIEF DESCRIPTION OF THE DRAWINGS

The features and advantages of the printed circuit board structure will be more clearly understood from the following description taken in conjunction with the accompanying drawings in which.

DESCRIPTION OF THE PREFERRED EMBODIMENTS

First Embodiment

Figure 1:
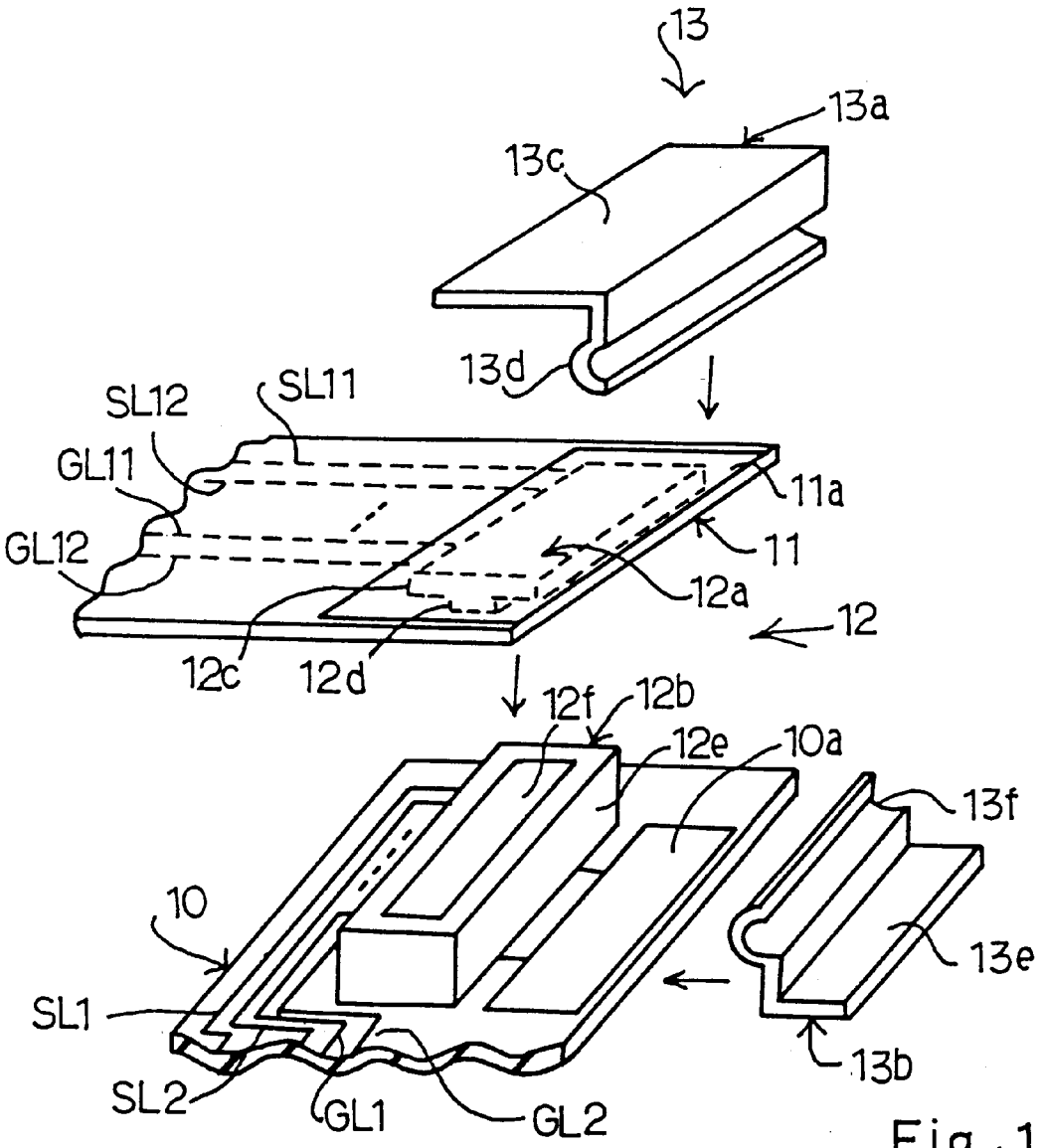
FIG. 1 is a perspective view showing a printed circuit board structure before assemblage.
Figure 2:
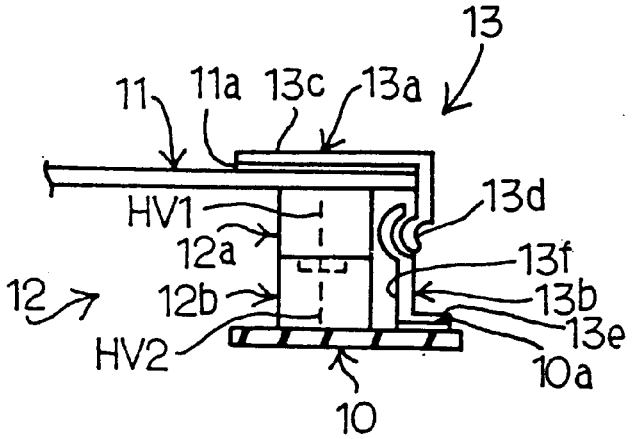
FIG. 2 is a front view showing the printed circuit board structure assembled after the assemblage.

Referring to FIGS. 1 and 2 of the drawings, a printed circuit board structure embodying the present invention largely comprises a printed circuit board 10, a flexible printed circuit film 11 spaced from the printed circuit board 10, a stacking connector 12 provided between the printed circuit board 10 and the flexible printed circuit film 11 and a coupling unit 13. Though not shown in FIGS. 1 and 2, the flexible printed circuit film 11 is soldered to another printed circuit board (not shown), and, accordingly, electrically connects the printed circuit board 10 to another printed circuit board (not shown).

Signal lines SL1/SL2 and ground lines GL1/GL2 are formed on an upper surface of the printed circuit board 10, and are selectively connected to semiconductor integrated circuit devices (not shown) and discrete circuit components (not shown) mounted on the printed circuit board 10. The signal lines SL1/SL2 and the ground lines GL1/GL2 are terminated at pins (not shown), respectively, and the pins are connected to conductive paths of the stacking connector 12. A ground pattern 10*a* is formed on the upper surface of the printed circuit board 10, and the pins for the ground lines GL1/GL2 are connected to the ground pattern 10*a*. Thus, the ground pattern 10*a* is grounded.

Signal lines SL11/SL12 and ground lines GL11/GL12 are formed on a lower surface of the flexible printed circuit film 11, and are also terminated at pins (not shown). The conductive paths of the stacking connector 12 are connected to the pins on the lower Surface of the flexible printed circuit film 11, and the signal lines SL1/SL2 and the ground lines GL1/GL2 are electrically connected through the conductive paths of the stacking connector 12 to the signal lines SL11/SL12 and the ground lines GL11/GL12, respectively. A ground pattern 11*a* is formed on the upper surface of the flexible printed circuit film 11, and is wider than the stacking connector 12. The stacking connector 12 occupies a certain area in the lower surface of the flexible printed circuit film 11, and an area in the upper surface opposite to the certain area are covered with the stacking connector 12. The stacking connector 12 is connected through via holes (not shown) to the pins for the ground lines GL11/GL12.

A male connector 12*a* and a female connector 12*b* form in combination the stacking connector 12. The male connector 12*a* includes a case 12*c* and halves HV1 of the conductive paths formed in the case 12*c*, and a protrusion 12*d* projects from the case 12*c*. The halves HV1 of the conductive paths are exposed to the surface of the protrusion 12*d*. The female connector 12*b* also includes a case 12*e* and remaining halves HV2 of the conductive paths, and a recess 12*f* is formed in the case 12*e*. The remaining halves HV2 of conductive paths are exposed to the bottom surface of the recess 12*f*.

The recess 12*f* is substantially identical in configuration with the protrusion 12*d*, and, for this reason, the protrusion 12*d* is snugly received in the recess 12*f*. When the protorusion 12*d* is inserted into the recess 12*f*, the halves HV1 of the conductive paths are respectively connected to the remaining halves, and the stacking connector 12 provides the electrical connections between the printed circuit board 10 and the flexible printed circuit film 11.

The coupling unit 13 includes a pair of conductive blocks 13*a* and 13*b* formed of phosphor bronze. The conductive block 13*a* is as wide as the ground pattern 11*a,* and has a contact portion 13*c* and a spoon-like engaging portion 13*d*. The contact portion 13*c* is attached to the ground pattern 11*a,* and the spoon-like engaging portion 13*d* downwardly projects from a side edge of the flexible printed circuit film 11. The other conductive block 13*b* is as wide as the conductive block 13*a*, and also has a contact portion 13*e* and a spoon-like engaging portion 13*f*. The contact portion 13*e* is attached to the ground pattern 10*a* on the printed circuit board 10, and the spoon-like engaging portion 13*f* upwardly projects from a side edge of the printed circuit board 10. The spoon-like engaging portions 13*d* and 13*f* are elastically deformable. When the male connector 12*a* is assembled with the female connector 12*b*, the spoon-like engaging portions 13*d* and 13*f* are elastically deformed, and are brought into mating engagement with each other as shown in FIG. 2.

When the printed circuit board 10 is assembled with the flexible printed circuit film 11 by means of the stacking connector 12 and the coupling unit 13, the coupling unit 13 extends along the side edges of the printed circuit board/flexible printed circuit film 10/11, and the stacking connector 12 is located at the back of the coupling, unit 13.

The coupling unit 13 electromagnetically shields the stacking connector 12, and undesirable electromagnetic noise hardly radiated from the stacking connector 12 to the outside of the printed circuit board structure. Thus, the coupling unit 13 serves as an electromagnetic shield. Moreover, the groused level is propagated through the coupling unit 13 between the ground patterns 10*a* and 11*a,* and the coupling unit 13 provides a bypass to the conductive paths in the stacking connector 12 assigned to the ground level. As a result, the coupling unit 13 decreases the impedance between the ground lines GL1/GL2 and GL11/GL12, and the electromagnetic noise is decreased. The male connector 12*a* is overlain by the ground pattern 11*a* and the rigid contact portion 13*c*, and the rigid contact portion 13*c* reinforces the flexible printed circuit film 11.

When the flexible printed circuit film 11 is separated from the printed circuit board 10, an operator slightly deforms the spoon-like engaging portion 13*d*, and disassembles the male connector 12*a* from the female connector 12*b*.

The reason why the printed circuit board structure is effective against the electro-magnetic noise rather than the second prior art structure is described as follows. When electric current flows a conductor, magnetic field is created around the conductor, and electric field is generated in a perpendicular direction to the magnetic field. This phenomenon is well known to a person skilled in the art. If electric current flows through another conductor provided in parallel to the conductor in the opposite direction, the current also creates magnetic field, and the magnetic field cancels the previous magnetic field. As a result, the current flowing through the another conductor weakens the electric field, and noise is reduced. Although the prior art stacking connector has the ground pins, the signal pins are much more than the ground pins, and the ground paths can not sufficiently cancel the noise. However, the coupling unit according to the present invention increases the electric path for the ground potential, and cancels most of the noise.

Second Embodiment

Figure 3:
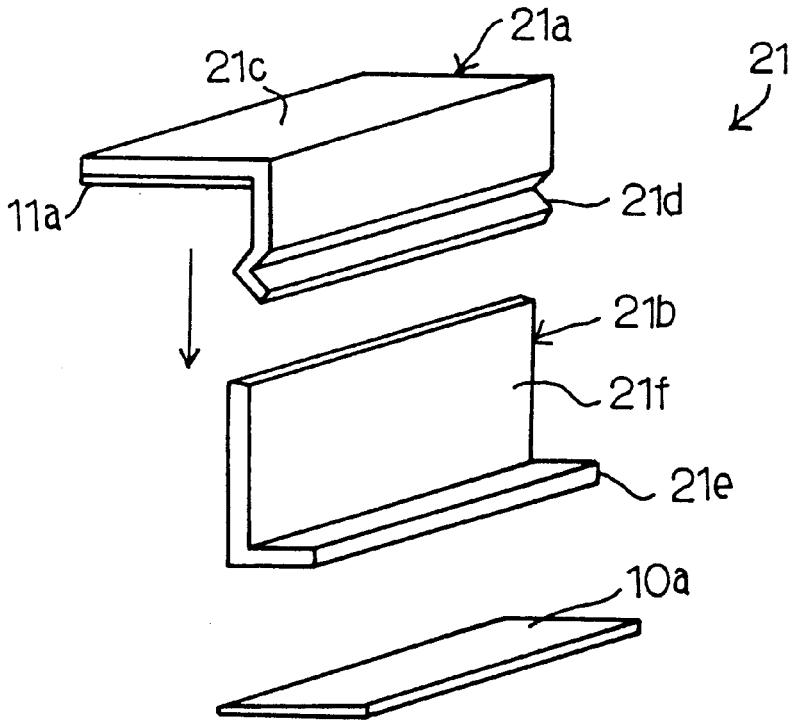
FIG. 3 is a perspective view showing a coupling unit incorporated in another printed circuit board structure according to the present invention.

FIG. 3 illustrates a coupling unit 21 incorporated in another printed circuit board structure embodying the present invention. The printed circuit board structure implementing the second embodiment is similar to the first embodiment except for the coupling unit 21, and other members are labeled with references designating corresponding components of the first embodiment without detailed description.

The coupling member 21 includes a conductive block 21*a* and a conductive wall member 21*b*. The conductive block 21*a* has a contact portion 21*c* attached to the ground pattern 11*a* and an engaging portion 21*d* downwardly projecting from the flexible printed circuit film 11, and the wall member 21*b* has a contact portion 21*e* attached to the ground pattern 10*a* and a vertical wall portion 21*f* upwardly projecting from the contact portion 21*e*. When the male connector 12*a* is inserted into the female connector 12*b*, the engaging portion 21*d* is elastically deformed, and is pressed against the wall portion 21*f*. The coupling member 21 achieves the advantages of the coupling member 12.

Third Embodiment

Figure 4:
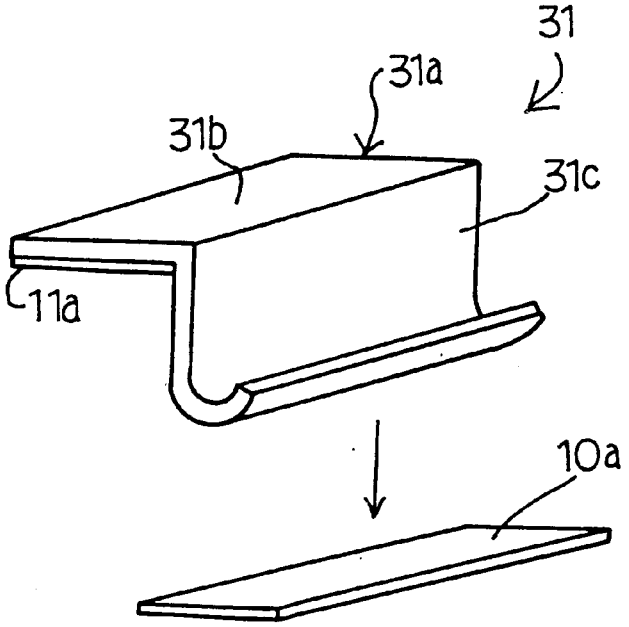
FIG. 4 is a perspective view showing another coupling unit incorporated in yet another printed circuit board structure according to the present invention.

FIG. 4 illustrates a coupling unit 31 incorporated in yet another printed circuit board structure embodying the present invention. The printed circuit board structure implementing the third embodiment is similar to the first embodiment except for the coupling unit 31, and other members are labeled with references designating corresponding components of the first embodiment without detailed description.

The coupling unit 31 is implemented by a single conductive block 31*a,* and the conductive block 31*a* has a contact portion 31*b* attached to the ground pattern 11*a* and a vertical wall portion 31*c*. The leading end of the vertical wall portion 31*b* is curved, and is pressed to the ground pattern 10*a*. The vertical wall portion 31*c* is deformable, and is elastically connected to the ground pattern 10*a*.

Although particular embodiments of the present invention have been shown and described, it will be obvious to those skilled in the art that various changes and modifications may be made without departing from the spirit and scope of the present invention.

What is claimed is:

1. A printed circuit board structure comprising a first printed circuit member having signal lines, ground lines and a first ground plate formed on a major surface thereof, a second printed circuit member having signal lines and ground lines formed on a first major surface thereof and a second ground plate formed on a second major surface thereof opposing said first major surface, a stacking connector inserted between said major surface of said first printed circuit member and said first major surface of said second printed circuit member and overlapping with said second ground plate, said stacking connector having a plurality of conductive paths connected between said signal lines and said ground lines of said first printed circuit member and said signal lines and said ground lines of said second printed circuit member, respectively, the conductive paths for said ground lines being further connected to said first ground plate and said second ground plate, and a coupling unit having a first contact portion and a second contact portion, said first contact portion being connected to said first ground plate on said major surface of said first printed circuit member and said second contact portion includes a substantially flat surface mounted on and connected to said second ground plate on said second major surface of said second printed circuit member so as to locate said stacking connector in a space between said first printed circuit member and said second printed circuit member at the back thereof, said coupling unit further providing a bypass to said conductive paths for said ground lines and a shield against electromagnetic noise radiated from said stacking connector.

2. The printed circuit board structure as set forth in claim 1, wherein said coupling unit includes a first conductive block attached to said first ground plate and having a vertical wall portion, and a second conductive block attached to said second ground plate and having an engaging portion elastically engaged with said vertical wall portion.

3. The printed circuit board structure as set forth in claim 1, wherein said coupling unit includes a conductive block attached to said second ground plate and an engaging portion elastically engaged with said first ground plate.

4. The printed circuit board structure as set forth in claim 1, wherein said first contact portion connects to said first ground plate on said major surface of said first printed circuit member.

5. The printed circuit board structure as set forth in claim 1, wherein an underside substantially flat surface of said second contact portion is mounted on and connected to said second ground plate on said second major surface of said second printed circuit member.

6. The printed circuit board structure as set forth in claim 1, wherein said substantially flat surface of said second contact portion is substantially parallel to said second ground plate.

7. The printed circuit board structure as set forth in claim 1, wherein said substantially flat surface of said second contact portion is substantially perpendicular to said first contact portion.

8. The printed circuit board structure as set forth in claim 1, in which said coupling unit includes a first conductive block attached to said first ground plate by said first contact portion, and a second conductive block attached to said second ground plate by said second contact portion, said coupling unit further having a first engaging portion extending from said first conductive block and a second engaging portion extending from said second conductive block elastically engaged with said first engaging portion.

9. The printed circuit board structure as set forth in claim 8, wherein said second engaging portion extends downward from said second conductive block and extends along a side edge of said second printed circuit board.

10. The printed circuit board structure as set forth in claim 8, wherein said first and second engaging portions are spoon-like engaging portions.

11. The printed circuit board structure as set forth in claim 10, wherein said first and second spoon-like engaging portions are elastically deformed when mated together.

12. The printed circuit board structure as set forth in claim 10, wherein a convex portion of said first spoon-like engaging portion engages a concave portion of said second spoon-like engaging portion.

13. The printed circuit board structure as set forth in claim 8, wherein said stacking connector includes a male connector mounted on one of said first printed circuit member and said second printed circuit member and having first portions of said plurality of conductive paths connected to said signal lines and said ground lines on said one of said first printed circuit member and said second printed circuit member, and a female connector mounted on the other of said first printed circuit member and said second printed circuit member and having second portions of said plurality of conductive paths connected to said signal lines and said ground lines on said other of said first printed circuit member and said second printed circuit member, said first engaging portion and said second engaging portion being elastically engaged with each other when said male connector and said female connector are brought into mating engagement with each other.

14. The printed circuit board structure as set forth in claim 13, wherein said male connector includes a case and a projection extending from said case, and said female connector includes a case and a recess in said case of said female connector, said protrusion is snugly fit into said recess when said male connector and said female connector are brought into mating engagement with each other.

15. A printed circuit board structure comprising a first printed circuit member having signal lines, ground lines and a first ground plate formed on a first surface thereof, a second printed circuit member having signal lines and ground lines formed on a first surface thereof and a second ground plate formed on a second major surface thereof, a stacking connector having a first case having a protrusion and a second case having a recess, said protrusion fitting snugly within said recess when said protrusion mates with said recess, said stacking connector being inserted between said first surfaces of said first and second printed circuit members, said stacking connector connecting said signal lines and said ground lines of said first and second printed circuit members, and a coupling unit having a first contact portion and a second contact portion, said first contact portion connected to said first ground plate and said second contact portion having a surface connected to said second ground plate on said second major surface of said second printed circuit member, said coupling unit further extending along a side edge of said second printed circuit board and further providing a bypass to said conductive paths for said ground lines and a shield against electromagnetic noise radiated from said stacking connector.

* * * * *